United States Patent [19]

Van Winkle

[11] 4,220,206

[45] Sep. 2, 1980

[54] QUICK OPENING CLOSURE ARRANGEMENT FOR WELL COMPLETIONS

[76] Inventor: Denzal W. Van Winkle, 411 Yorkchester, Houston, Tex. 77079

[21] Appl. No.: 5,326

[22] Filed: Jan. 22, 1979

[51] Int. Cl.[3] ..... E21B 43/12

[52] U.S. Cl. ..... 166/318; 285/3; 166/317

[58] Field of Search ..... 285/3, 4, 370, 397; 166/317, 318, 315

[56] References Cited

U.S. PATENT DOCUMENTS

| | | | |
|---|---|---|---|
| 2,843,399 | 7/1958 | Artebury et al. | 285/3 |
| 3,007,523 | 11/1961 | Vincent | 166/318 |
| 3,029,875 | 4/1962 | Moller | 166/317 |
| 4,073,511 | 2/1978 | Haas et al. | 285/3 |
| 4,105,074 | 8/1978 | Armstrong | 166/317 |

*Primary Examiner*—William F. Pate, III

*Attorney, Agent, or Firm*—Jack W. Hayden

[57] ABSTRACT

A quick opening closure arrangement for controlling flow from a well formation into a tubular member which may be opened by dropping a rod or the like into the tubular member adjacent the earth's surface wherein closure means are provided for closing off the tubular member from the well formation as the tubular member is positioned in the well. Sleeve means support the closure means to close off flow into the tubular member from the well formation and releasable means releasably secure the sleeve means within the tubular member which releasable means is constructed and arranged to enable the sleeve means to shift longitudinally within the tubular member when a rod dropped into the tubular member from the earth's surface impacts thereagainst whereupon the closure means moves to open the tubular member for receiving flow from the formation.

13 Claims, 13 Drawing Figures

QUICK OPENING CLOSURE ARRANGEMENT FOR WELL COMPLETIONS

SUMMARY OF THE INVENTION

Some wells, particularly such as oil and gas wells, are completed by positioning a tubular string of well pipe within the well bore with a packer sealing between the exterior of such pipe string and the surrounding surface in the well bore. The lower end of the pipe string beneath the packer in such completion technique is closed off to intially inhibit or prevent flow from the well bore producing formation into the pipe string.

Such closure of the lower end has heretofore been effected in one of several ways such as for example, by a frangible disc which has presented on some occasion certain disadvantages. For example, it may be subject to premature failure and the frangible disc arrangements heretofore used have on occasion left splinters projecting into the tubing thus preventing or interfereing with full access to the tubing and well bore therebeneath.

Because of the problems encountered in connection with such frangible disc arrangements, a second method has been employed wherein a wireline retrievable blanking plug is run above the frangible disc. However, this is disadvantageous in that it requires the additional operation of removing the blanking plug before dropping suitable means such as a bar or rod from the earth's surface to break the frangible disc and effect opening of the lower end of the tubular member for receiving flow from the formation in the well bore.

The present invention overcomes the above objections and provides a relatively simple, quick opening closure arrangement for initially preventing flow into a tubular member from a formation as the tubular member is positioned in the well bore but which may be readily actuated to open the tubular member and provide a full bore opening in the tubular member for access therethrough at a later time should such be desired.

In addition, one form of the present invention provides an arrangement whereby a recovery of a portion of the closure arrangement of the present invention may be effected should the producing string be retrieved or removed from the well bore at a later date during workover or other operations.

Yet a further object of the present invention is to provide a closure arrangement including closure means for closing off a tubular member from a well formation; sleeve means for supporting the closure means to close off flow into the tubular member from the well formation; and releasable means releasably securing said sleeve means within the tubular member which releasable means is constructed and arranged to enable said sleeve means to shift longitudinally within the tubular member when a rod is dropped in the tubular member from the earth's surface to impact thereagainst so that the closure means is actuated to open the tubular member for flow from the formation.

Yet a further object of the present invention is to provide a closure arrangement including closure means for closing off a tubular member from a well formation; sleeve means for supporting the closure means to close off flow into the tubular member from the well formation; releasable means releasably securing said sleeve means within the tubular member which releasable means is constructed and arranged to enable said sleeve means to shift longitudinally within the tubular member when a rod is dropped in the tubular member from the earth's surface to impact thereagainst so that the closure means may move to open the tubular member for flow from the formation, said sleeve means supporting said closure means by snap ring means extending therebetween.

Yet a further object of the present invention is to provide a closure arrangement including closure means for closing off a tubular member from a well formation; sleeve means for supporting the closure means to close off flow into the tubular member from the well formation; releasable means releasably securing said sleeve means within the tubular member which releasable means is constructed and arranged to enable said sleeve means to shift longitudinally within the tubular member when a rod is dropped in the tubular member from the earth's surface to impact thereagainst so that the closure means is actuated to open the tubular member for flow from the formation, said closure meand comprising a closed bottom sleeve member having an open upper end.

Still another object of the invention is to provide a quick opening closure arrangement for controlling flow from a well formation into a tubular member which closure arrangement may be opened by dropping a rod or the like into the tubular member adjacent the earth's surface comprising sleeve means within the tubular member, closure means releasably and sealably positioned adjacent the lower end of the sleeve means and means for releasably securing said sleeve means within the tubular member which releasable means is constructed and arranged to enable said sleeve means to shift longitudinally within the tubular member when the rod dropped into the tubular member compacts thereagainst whereupon the closure means opens the tubular member for flow from the formation.

Yet another object is to provide a quick opening closure arrangement for controlling flow from a well formation into a tubular member which closure arrangement may be opened by dropping a rod or the like into the tubular member adjacent the earth's surface comprising sleeve means within the tubular member, closure means releasably and sealably positioned adjacent the lower end of the sleeve means and means for releasably securing said sleeve means within the tubular member which releasable means is constructed and arranged to enable said sleeve means to shift longitudinally within the tubular member when the rod dropped into the tubular member compacts thereagainst whereupon the closure means is actuated to open the tubular member for flow from the formation, therebeing seal means between said sleeve means and tubular member spaced longitudinally to form a closed chamber at substantially atmospheric pressure, such seal means being responsive to formation pressure to move said sleeve means upwardly within the tubular member after the plug means is released therefrom, and cooperating surface means on the tubular member and said sleeve means to lock said sleeve means after it has moved upwardly within the tubular member.

Other objects and advantages will become apparent from the following description and drawings.

DESCRIPTION OF THE PREFERRED EMBODIMENTS

Figure 1:
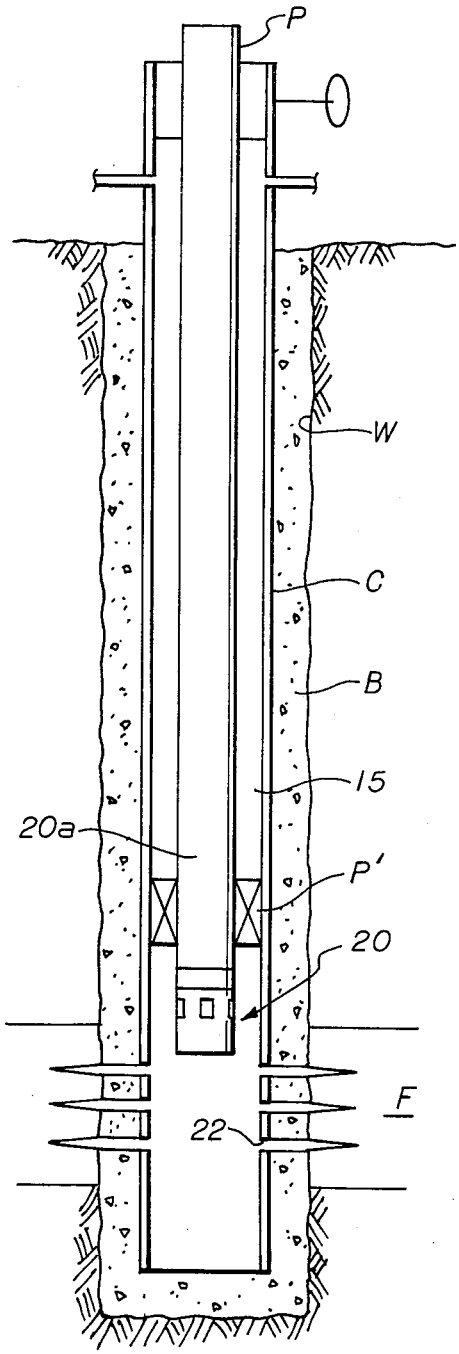
FIG. 1 is a vertical section of a well bore illustrating a casing positioned in the well bore with a production string therein having a packer affixed between the production string and the casing adjacent the lower end of the production string with the closure means of the present invention in position on the lower end of the tubular member.

Attention is first directed to FIG. 1 of the drawings wherein a well bore is illustrated generally by the letter W. A casing C is illustrated as being positioned in the well bore W by a suitable bonding means such as cement illustrated at B and a production string represented by P is positioned within the casing C as shown. The production string P is formed by tubular members 20*a* threadedly connected together. A packer P is positioned in the annular space 15 between the casing C and production well string P adjacent the lower end thereof as illustrated.

The present invention is represented generally by the numeral 20 and is releasably secured or maintained in position adjacent the lower end of the lowermost tubular member 20*a* in the production string P as it is lowered into position in the well bore thus closing off flow from the formation F in the well bore W to the interior of the production string P.

After the present invention has been actuated, the lower end 21 of the production string P is opened for receiving flow from the formation F through the perforations 22 in the casing C. The construction and arrangement of the present invention is such that after opening the lower end of the production string P, the production string P is full bore so as not to interfere with the running of any tools or any other instruments such as pressure bombs or temperature bombs therethrough if desired.

In the FIGS. 3–6 form of the present invention, closure means represented generally at 25 in the form of a sleeve 26 having a lower closed end 27 and an open upper end 28 is illustrated. It will be noted that the closure means 25 is provided with a conforming shaped surface 29 adjacent its open upper end 28 to conform with a shaped surface 30 on the lower end of the last tubular member 20*a* in production string P. Sleeve means referred to generally at 35 extend longitudinally within the lowermost tubular member 20*a* in production string P as shown in FIGS. 3 thru 6. Releasable means referred to generally at 40 are provided for releasably securing said sleeve means 35 within the tubular member 20*a* but which may be actuated to disengage the sleeve means for movement longitudinally relative to the tubular member 20*a*.

Seal means 32 are provided between the sleeve means 35 and the tubular member 20*a* and seal means 33 are provided between the sleeve means 35 and the closure means 25.

Suitable means such as a snap ring 34 is employed in the form of the invention illustrated in FIGS. 3 thru 9 to enable the sleeve means 35 to support the closure means 25 in position on the tubular member 20*a* to close off flow from the formation W into the tubular member 20*a* and production string P until the present invention has been actuated.

It will be noted that the diameter of the seal means 33 between the sleeve means 35 and closure means 25 is on a larger diameter than the seal means 32 between the sleeve means 35 and tubular member 20*a* so that pressure from the formation W will tend to urge the sleeve means 35 downwardly due to the pressure differential across the two seal means 32, 33. Suitable ports 25*a* are provided in the closure means 25 between the seals 33 and 32 as shown in the drawings.

The releasable means 40 includes shoulder means 38 on the interior of the tubular member P which extends continuously circumferentially thereof and shoulder means 39 formed adjacent the upper end of sleeve means 35. Also, the upper portion of the sleeve means 35 is in the form of a plurality of circumferentially spaced and longitudinally extending members 41 on which the shoulder means 39 is formed adjacent the upper end of each. This arrangement forms generally what is termed a collet means, and a disc means 45 is positioned adjacent the upper end of the members 41 and releasably retained in such position by any suitable means such as screws or hollow expanding rivets 46. As long as the disc means 45 retains the position shown in FIG. 3 of the drawings, the shoulder means 39 is retained in position to engage the shoulder means 38 of the tubular member 20*a* thus retaining the sleeve means 35 and the closure means 25 supported thereon in position to close off the lower end of the tubular member 20*a*.

Figure 6:
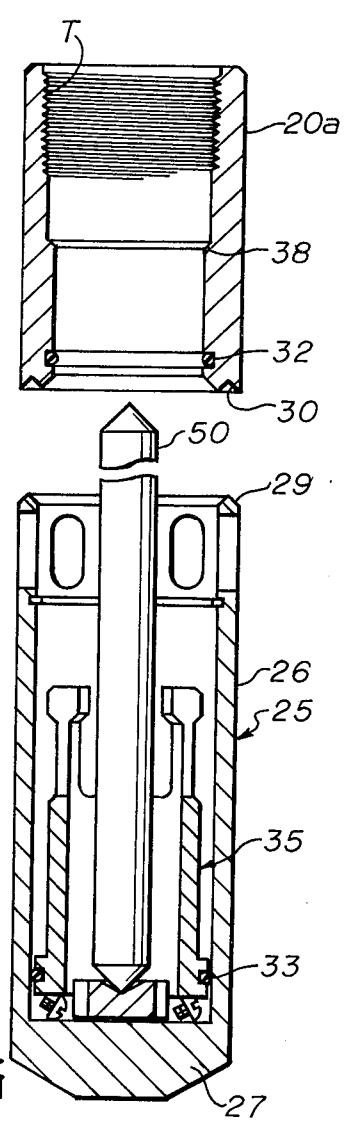
FIG. 6 illustrates the disconnection of the closure means of FIG. 3 and its movement away from the lower end of the tubular member after the release means between the sleeve means and the tubular member has been effected.
Figure 5:
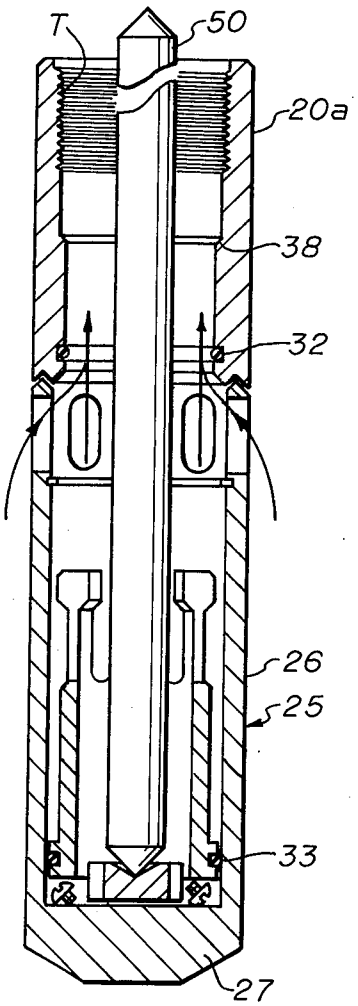
FIG. 5 illustrates movement of the sleeve means in response to pressure from the formation after the release means has been actuated to release said sleeve means from the closure member.
Figure 4:
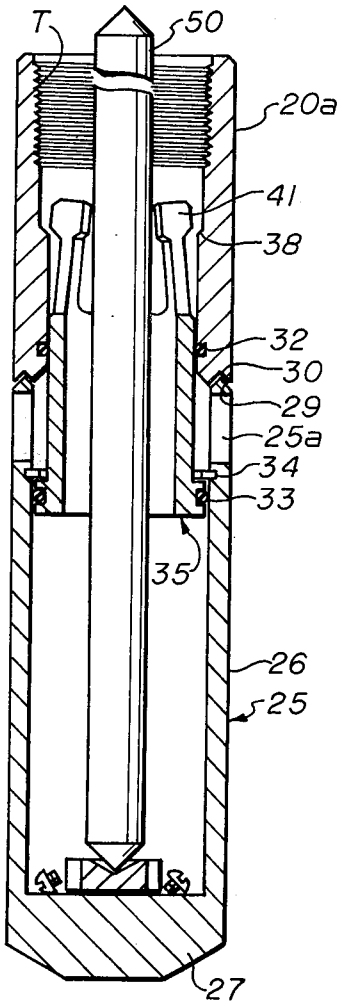
FIG. 4 illustrates embodiment of FIG. 3 of the present invention after a rod has been dropped into the tubular member adjacent the earth's surface to actuate the release means between the sleeve means and the tubular means.
Figure 3:
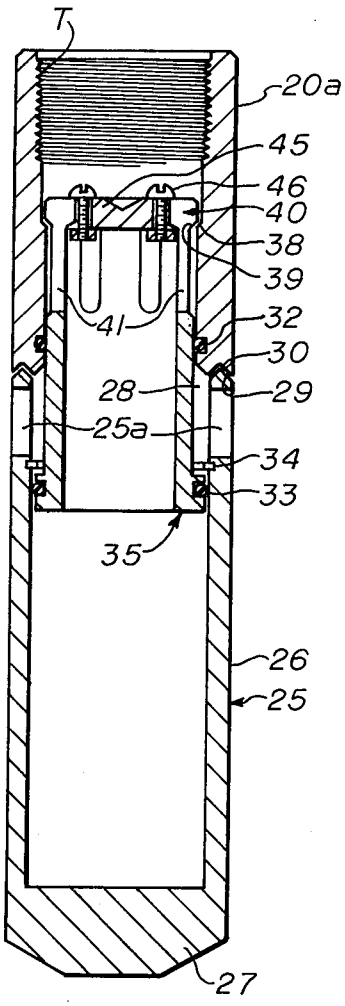
FIG. 3 is a sectional view illustrating one embodiment of the present invention.

However, when a rod or weighted member 50 is dropped in the production string P from adjacent the earth's surface and impinges against the releasable means 40, and more particularly the disc 45 of such release means, the releasable securing means 46 shears, and as illustrated in FIG. 4 the members 41 of the collet means may move radially inwardly in response to pressure from the formation F acting on the seal means 33 and thereupon the sleeve means 35 moves downwardly to the position illustrated in FIG. 6.

Normally the present invention is employed in a situation so that the tubular members 20*a* forming the well string P are empty internally as it is lowered into the well bore, and the surrounding pressure in the formation F is greater than the pressure internally of such empty well string P.

Figure 2:
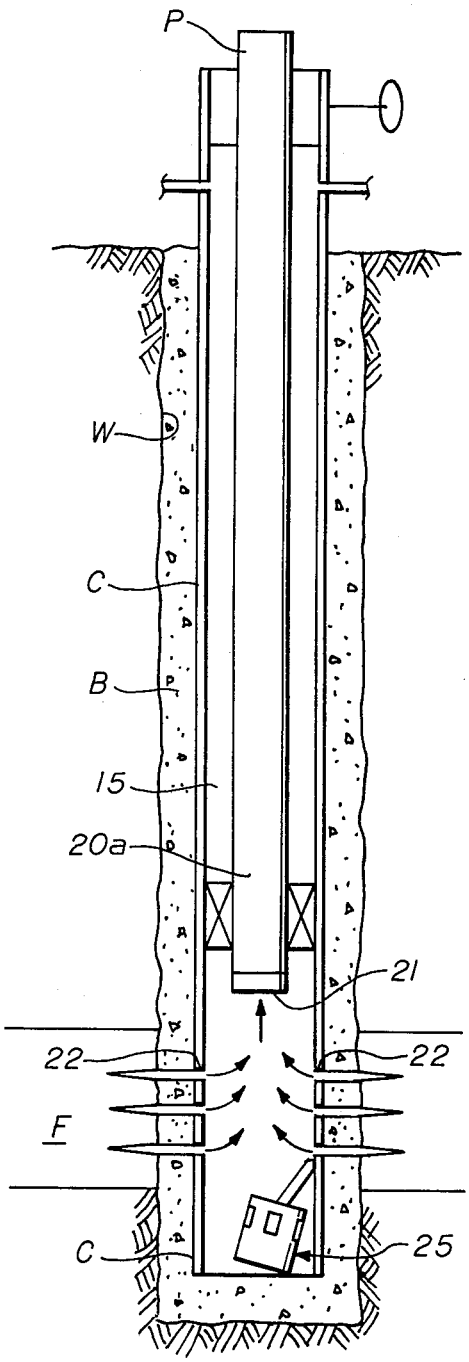
FIG. 2 illustrates the relationship of the closure means of some forms of the present invention after it is has been actuated to open the tubular member for receiving flow from the well formation into the tubular member.

However, since the closure means 25 is supported by the sleeve means 35 and more particularly the snap ring 34 extending therebetween, when the fingers 41 move radially inwardly, the closure member 25 is free to fall away from the lower end of the well string P whether or not there is any pressure differential acting on the seals 32, 33. In those instances where the present invention is employed in a well with a high flow rate, there may be enough pressure to tend to hold the closure member 25 in place adjacent the lower end of the lowermost tubular member 20*a* for a relatively short interval such as a few seconds. However, after the disc means 45 has been sheared there is no mechanical force holding the closure means 25 in place so that it may fall to the bottom of the well bore within the casing C as illustrated in FIGS. 2 and 6 of the drawings.

In some applications it may be desirable to assure that the sleeve means 35 and the closure means 25 opens to expose maximum flow area from the formation F into the lower end 21 of the tubular member 20*a* without any obstruction by the rod 50.

Figure 7:
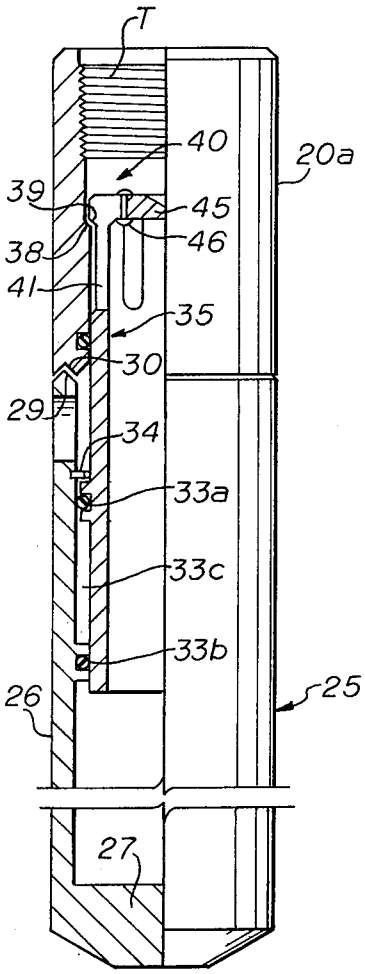
FIG. 7 is a quarter sectional view illustrating an alternate embodiment of the present invention wherein the closure means is shown in the form of a sleeve means having a closed lower end and an open upper end similar to that of FIGS. 3–6, but with a spaced seal arrangement between the sleeve means and the closure means which forms a chamber at atmospheric pressure so that the pressure in the well acts against the seal means between the sleeve means and the closure means to tend to urge the sleeve means downwardly out of the tubular member.

In the form of the invention illustrated in FIG. 7, it can be seen that the longitudinal extent of the closure means 25 has been extended to accommodate the full length of the rod 50 therein.

Also, in this form of the invention a pair of seal means 33*a* and 33*b* are provided between the sleeve means 35 and the closure means 25. Since the arrangement of the present invention is assembled at the earth's surface, it can be appreciated that the longitudinal spacing of the seals 33*a*, 33*b* and the space between the inner diameter of the closure 25 and the outer diameter of the sleeve means 35 forms a chamber 33*c* which is substantially at atmospheric pressure. It will be noted that the diameter of the seal 33*a* is larger than the diameter of the seal 33*b* thus, the pressure from the formation F acts on the seal means 33*a* to tend to urge the sleeve means 35 downwardly out of the lower end 21 of the tubular member 20*a*.

Otherwise, the structural arrangement of the release means 40 and the other structure is generally similar to that described with regard to FIGS. 3–6.

Figure 8:
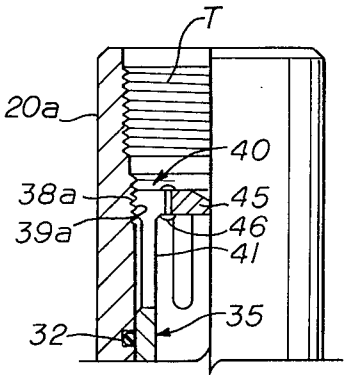
FIG. 8 is a quarter sectional view of the upper portion of the quick opening closure arrangement of the present invention illustrating an alternate form of collet means for releasably securing the sleeve means to the tubular member.

In FIG. 8, the shoulder means 38*a* on the tubular member 20*a* is illustrated as being in the form of circumferentially continuous threads 38*a* and the shoulder means 39 on the end of the members 41 is provided with mating threads 39*a*. As is the case with the form of the invention in FIGS. 3–7, the disc means 45 is provided with the releasable securing means 46 to retain the threads 38*a* and 39*a* engaged as long as the disc is in the position shown; however, when the rod 50 impinges thereagainst, the members 41 are free to move radially inwardly to enable the closure means 25 (not shown) supported by the sleeve means 35 to be released from the tubular member for flow into the tubular member 20*a* from the formation F.

Figure 9:
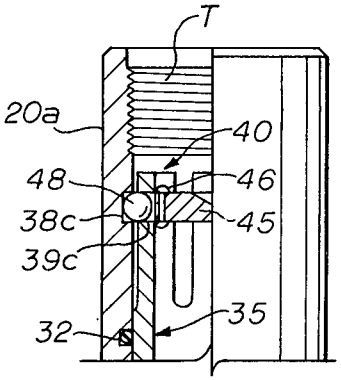
FIG. 9 is a partial quarter sectional view of the upper end of the closure arrangement of the present invention illustrating still another modification of the releasable means between the sleeve means and the tubular member.

In FIG. 9, the shoulder means on the tubular member 20*a* is shown as being in the form of a continuous annular recess 38*c*. The shoulder means on the sleeve member 35 is also in the form of a recess or opening 39*c* which is formed in the sleeve member 35 as shown. After ball means 48 have been inserted to extend between or span the recesses 38*c* and 39*c* as shown in FIG. 9 of the drawings, the disc means 45 is releasably positioned by the means 46 adjacent the recess 39*c*. This retains the sleeve member 35 in position in the tubular member 20*a* and supports the closure means (not shown) to close off the tubular member 20*a* as described with regard to FIGS. 1–8.

When the disc means 45 has been engaged by the rod 50, such disc means is released from its position enabling the ball means 48 to disengage from between the recesses 38*c*, 39*c* to accommodate longitudinal movement of the sleeve means 35 in a manner as described with regard to the FIGS. 3–8 embodiments.

Figure 10:
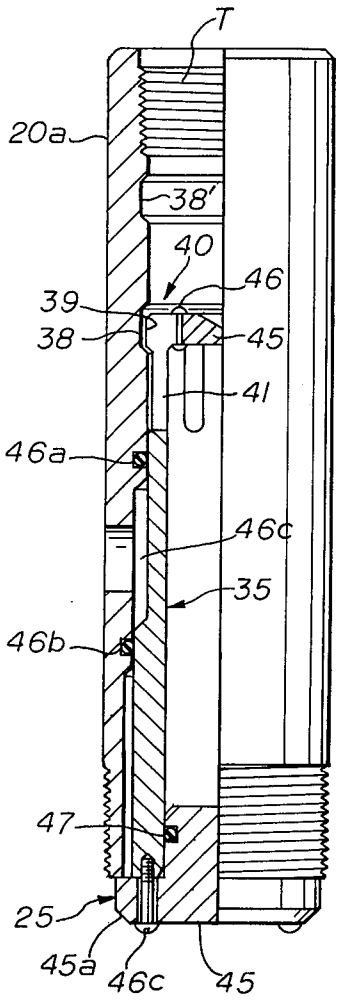
FIG. 10 is a quarter sectional view of still another embodiment of the present invention where the closure means is plug means releasably and sealably secured adjacent the lower end of the sleeve means which sleeve means is releasably positioned within the tubular member. Spaced seal means are provided between the sleeve means and the tubular member to form a closure chamber at substantially atmospheric pressure so that when the releasable means has been actuated to enable the sleeve means to move longituindally of the tubular member and activate the closure means, the sleeve means will move upwardly and lock in position within the tubular member to be retrieved from the well bore therewith.

In the FIG. 10 form of the invention, the sleeve means 35 is shown as being provided with a closure means 25 in the form of a plug means 45 as shown in FIG. 10. The plug means 45 is provided with circumferentially spaced and radially extending projections 45*a* that extend beyond the end of the sleeve means 35 as shown to enable the plug means 45 to be releasably secured with the sleeve means 35 by any suitable means such as the shear screws 46*c*. Suitable seal means 47 are provided between the plug means 45 and sleeve means 35 as shown.

In this form of the invention the shoulder means 38 in the well string P is in the form of an annular recess having diverging sides as illustrated which mate with the shoulder means 39 which have conforming surfaces to mate with groove 38 formed in the lowermost tubular member 20*a*.

When the sleeve means 35 is assembled in the closure arrangement at the earth's surface, it is provided with spaced seal 46*a* and 46*b* as shown between the sleeve means and the tubular member 20*a*. The seal means 46*b* are on a larger diameter than the seal means 46*a* thus creating a surface area that is responsive to the formation pressure in the well bore to tend to urge the sleeve means 35 upwardly longitudinally within the well string P.

When the rod 50 is dropped into the well string P at the earth's surface and actuates the release means 40 by shearing 46, either the weight of the rod 50 and/or formation pressure acting against the seal means 46*b* will cause the shear screws 46*c* to release enabling the plug 45 to drop out of the sleeve 35. The sleeve means 35 continues its upward movement within the tubular member 20 to engage in the additional shoulder means 38' in the tubular member 20*a* spaced upwardly longitudinally above the shoulder means 38 as shown in FIG. 10 of the drawings.

After the plug means 45 has been disengaged from the sleeve means 35, the lower end 21 of the tubular member 20*a* is open full bore to receive fluid from the formation F.

Figure 11:
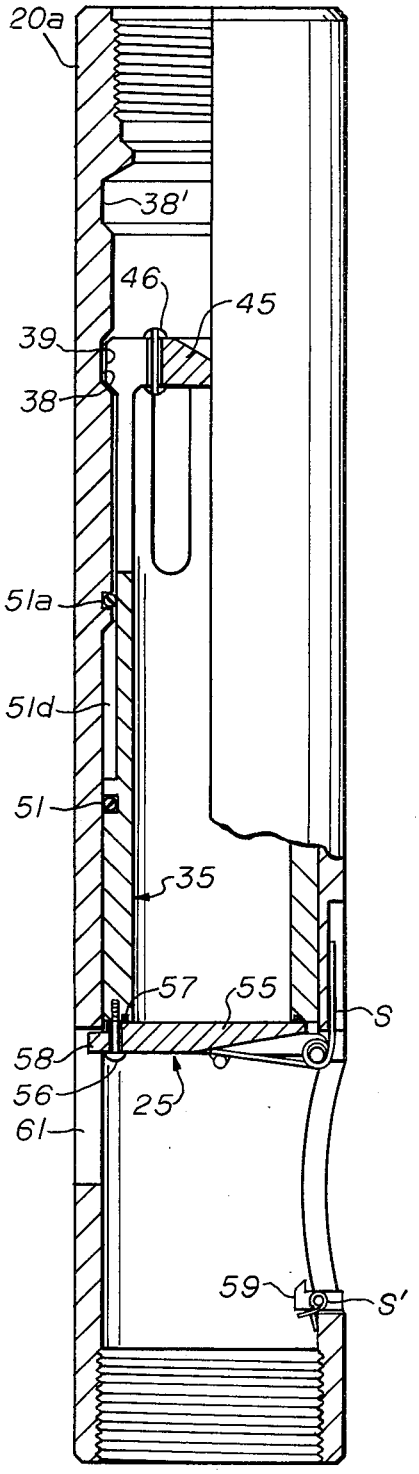
FIG. 11 illustrates still another form of the present invention wherein the closure means is shown as being in the form of a spring loaded flapper valve releasably secured to the sleeve means, with the sleeve means being in turn releasably secured to the tubular member as in the other modifications. Spaced seal means provide a closed chamber between the sleeve means and tubular member which is at atmospheric pressure. When the release means between the sleeve means and tubular member have been actuated the seal means arrangement between the sleeve means and the tubular member causes the sleeve means to move up and effects shearing of the means retaining the flapper valve in closed position whereupon its spring means snaps it to open position.
Figure 13:
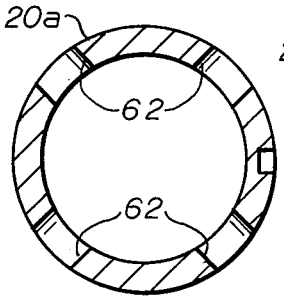
FIG. 13 illustrates flow ports into the tubular member which along with the port in the tubular member beneath the flapper valve shown in FIG. 12 accommodate formation flow into the well string after the sleeve means has moved upwardly within the well string.
Figure 12:
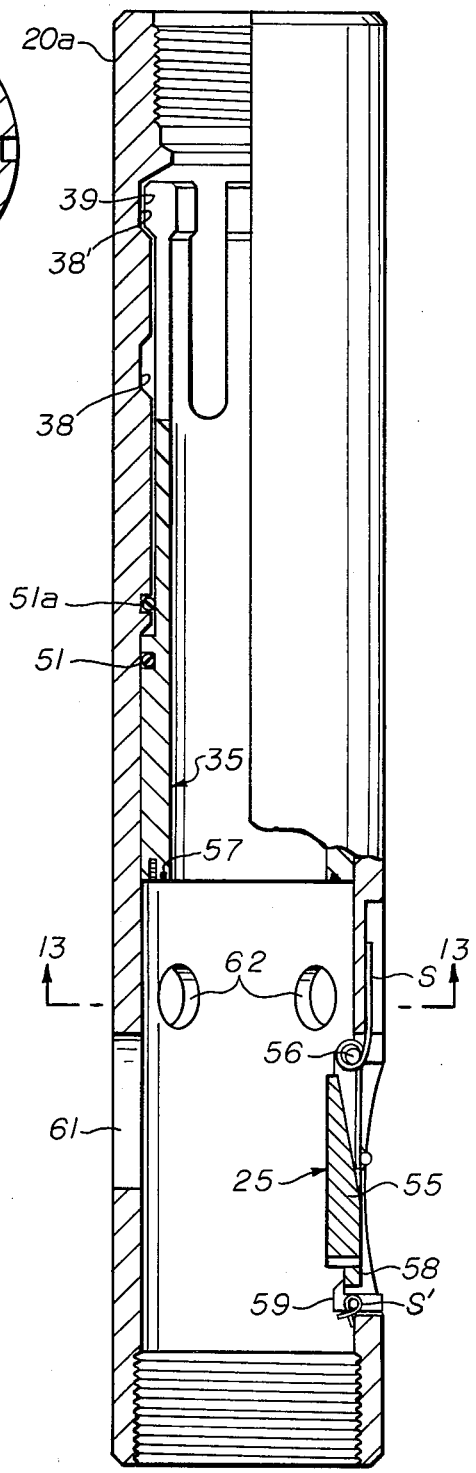
FIG. 12 illustrates the arrangement of the flapper valve when it is in open position and secured in such open position.

In the form of the invention illustrated in FIGS. 11–13, the sleeve means 35 is initially engaged with shoulder means 38 in the tubular member 20*a*, such shoulder means being in the form of annular grooves having diverging side surfaces as shown in the drawings. Seal means 51 and 51*a* are provided between the sleeve means 35 and tubular member 20*a* and are longitudinally spaced as illustrated to form chamber 51*d* therebetween. The annular chamber 51*d* between the tubular member 20*a* and the sleeve means 35 is at substantially atmospheric pressure when the closure arrangement of the FIG. 11–13 is assembled at the earth's surface.

The closure means 25 in the embodiment illustrated in FIGS. 11–13 is in the form of a flapper valve 55 which is pivotally carried at 56 on the tubular member 20*a* and is urged towards open position by the spring S. To assist in retaining the flapper valve 55 in closed position a shear screw 56 may be engaged in the lower end of the sleeve means 35 as shown. Suitable seal means 57 are provided between the flapper valve 55 and the lower end of the sleeve means 35 to close off the interior of the well string P from the surrounding well bore into which such well string with the present invention is lowered into.

It will be noted that the tubular member 20*a* forming part of production string P is provided with additional shoulder means 38' spaced longitudinally above the shoulder means 38 in a manner as described with regard to the embodiment shown and described in FIG. 10.

Similarly, the seal means 51 is on a larger diameter than the seal means 51*a* and after the rod 50 has been dropped through the well string P to impinge against the disc means 45 and shear the shear means 46, the members 41 may move radially inwardly and either the weight of the rod or the pressure of the formation, or a combination of the two will cause the shear screw 56 to shear, thus enabling the flapper valve 55 to move downwardly and outwardly. Since the spring S tends to urge the flapper valve 55 towards open position, it assists in moving the flapper valve 55 towards open position and the projecting lip 58 of such flapper valve 55 will engage with the latch 59 pivotally carried at 60 on the tubular member 20*a* and retained in operating position by the spring S'. After the lip 58 of the flapper valve 55 has engaged the latch 59 as shown in FIG. 12 of the drawings, it will be retained in such position.

Fluid flow may then occur thru the lower end 21 of the tubular member 20*a* by means of the port 61, as well as through the ports 62 in the tubular member 20*a*.

It can be appreciated that at this time, formation pressure has moved the sleeve means 35 upwardly within the well string P so as to engage the shoulder means 39 on the members 41 in the additional shoulder means 38'.

From the foregoing description it can be appreciated that the present invention provides a quick opening closure arrangement which retains the well string closed as it is lowered into the well bore and until the rod 50 is dropped into the well string P to cause actuation thereof.

After the closure means of the present invention has been actuated, it presents a smooth full opening bore throughout the well string for receiving fluids therein or for receiving well tools downwardly therethrough as may be desired.

The foregoing disclosure and description of the invention are illustrative and explanatory thereof, and various changes in the size, shape, and materials as well as in the details of the illustrated construction may be made without departing from the spirit of the invention.

What is claimed is:

1. A quick opening closure arrangement for controlling flow from a well formation into a tubular member which may be opened by dropping a rod or the like into the tubular member adjacent the earth's surface comprising:

a. closure means for closing off the tubular member from the well formation;

b. sleeve means supporting said closure means to close off flow into the tubular member from the well formation;

c. releasable means releasably securing said sleeve means within the tubular member which releasable means is constructed and arranged to enable said sleeve means to shift longitudinally within the tubular member when the rod dropped into the tubular member impacts thereagainst whereupon the closure means opens the tubular member for flow from the formation; and d. longitudinally spaced seal means on said sleeve means, one of which seal means is on a larger diameter than the other and responsive to well formation flow to assist in shifting said sleeve means.

2. The invention of claim 1 wherein said releasable means comprises:

a. shoulder means on said sleeve means engagable with shoulder means on the tubular member;

b. disc means releasably carried by said sleeve means to normally retain said shoulder means on said sleeve means in engagement with said shoulder means on the tubular member, said disc means disengaging from said sleeve means when the rod dropped in the tubular member from the surface impinges thereagainst whereby said shoulder means on said sleeve means may move inwardly and disengage from the tubular member shoulder means.

3. The invention of claim 2 wherein the shoulder means on the tubular member extends continuously annularly within the tubular member.

4. The invention of claim 2 wherein said shoulder means on said sleeve means is in the form of collet means.

5. The invention of claims 3 or 4 wherein the shoulder means on the tubular member is threaded and wherein said collet means is provided with threaded portions for engagement with the threads on the tubular member shoulder.

6. The invention of claims 2, 3 or 4 wherein:

a. the shoulder means on each the tubular member and said sleeve means is formed by an annular recess therein;

b. ball means extending between the recesses; and c. said disc means is releasably positioned adjacent the recess in said sleeve means by said releasable means to normally retain said ball means extending between the recesses, said ball means being released from extending between the recesses when the rod impinges against said disc means and releases it from said sleeve means.

7. The invention of claim 1 wherein said sleeve means supports said closure means by snap ring means extending therebetween.

8. The invention of claim 1 wherein said sleeve means supports said closure means by shear means extending therebetween.

9. The invention of claim 1 wherein said longitudinally spaced seal means are between the tubular member and said sleeve means and between said sleeve means and said closure means.

10. The invention of claim 1 wherein said closure means comprises a closed bottom sleeve member having an open upper end.

11. The invention of claim 1 wherein said closure means comprises plug means adjacent the lower end of said sleeve means.

12. The invention of claim 1 wherein:

a. said longitudinally spaced seal means are between the tubular member and said sleeve means and between said sleeve means and said closure means;

b. said seal means between said sleeve means and the tubular member comprise a pair of upper and lower seals spaced longitudinally with the inner diameter of the tubular member reduced therebetween to form a sealed chamber at substantially atmospheric pressure; and c. the diameter of the lower of said pair of seal means being larger than the diameter of said upper of said pair of seal means whereby pressure from the formation after said closure means is actuated to open the tubular member moves said sleeve means upwardly within the tubular member.

13. The invention of claim 12 wherein the tubular member is provided with additional shoulder means spaced above said first mentioned shoulder means with which said shoulder means on said sleeve means engages to retain said sleeve means within the tubular member after the closure member is actuated to open the tubular member.

* * * * *